US008895898B2

(12) United States Patent
Lim et al.

(10) Patent No.: US 8,895,898 B2
(45) Date of Patent: Nov. 25, 2014

(54) POSITIVE TEMPERATURE COEFFICIENT (PTC) ROD ASSEMBLY AND PTC HEATER USING THE SAME

(75) Inventors: Jae Chan Lim, Ulsan (KR); Man Ju Oh, Ulsan (KR); Duck Chae Jun, Seongnam-si (KR); Tae Soo Sung, Asan-si (KR)

(73) Assignees: Hyundai Motor Company, Seoul (KR); Kia Motors Corporation, Seoul (KR); Modine Korea, LLC., Asan-Si (KR)

( * ) Notice: Subject to any disclaimer, the term of this patent is extended or adjusted under 35 U.S.C. 154(b) by 1134 days.

(21) Appl. No.: 12/479,197

(22) Filed: Jun. 5, 2009

(65) Prior Publication Data

US 2010/0140245 A1 Jun. 10, 2010

(30) Foreign Application Priority Data

Dec. 5, 2008 (KR) ..... 10-2008-0123102

(51) Int. Cl.
*H05B 1/00* (2006.01)
*H05B 3/24* (2006.01)
*H05B 3/42* (2006.01)

(52) U.S. Cl.
CPC .. *H05B 3/24* (2013.01); *H05B 3/42* (2013.01); *H05B 2203/02* (2013.01)
USPC ..... 219/202; 219/260; 219/520

(58) Field of Classification Search
USPC ..... 219/203, 207, 208, 385, 504, 505, 520, 219/530, 537, 536, 540, 541, 544, 548, 553, 219/630; 156/291, 292; 338/22 R, 22 SD, 338/23, 220, 226, 268, 315; 428/446; 392/347, 377, 465, 485; 165/153, 152, 165/175, 177, 181; 361/272; 174/52 R
See application file for complete search history.

(56) References Cited

U.S. PATENT DOCUMENTS

| | | | | |
|---|---|---|---|---|
| 3,584,189 | A * | 6/1971 | Marcoux | 219/209 |
| 5,471,034 | A * | 11/1995 | Kawate et al. | 219/485 |
| 5,756,215 | A | 5/1998 | Sawamura et al. | |
| 7,649,438 | B2 | 1/2010 | Ikeda et al. | |
| 2002/0053562 | A1 | 5/2002 | Cuillery et al. | |
| 2007/0018777 | A1 | 1/2007 | Seock | |
| 2007/0045274 | A1 * | 3/2007 | Lee | 219/222 |

(Continued)

FOREIGN PATENT DOCUMENTS

| | | | | |
|---|---|---|---|---|
| CN | 2094843 U | * | 1/1992 | H05B 3/00 |
| CN | 91208163.5 | | 1/1992 | |

(Continued)

*Primary Examiner* — Thien S Tran
(74) *Attorney, Agent, or Firm* — Morgan, Lewis & Bockius LLP

(57) ABSTRACT

A positive temperature coefficient (PTC) rod assembly is provided for a PTC heater. PTC elements and an electrode terminal to which an insulator is attached may be retained in a channel-shaped rod cover having an open side so as to be exposed to the outside, and a heat-radiating fin is in direct contact with one surface of the rod cover so as to conduct heat, and another heat-radiating fin may be in direct contact with one surface of the insulator attached to an outer surface of the electrode terminal so as to conduct heat, so that the PTC rod assembly minimizes empty space in an inner space of the rod cover, increases heat transfer efficiency, and is easily manufactured due to a simple structure and reduction in the number of parts.

5 Claims, 4 Drawing Sheets

(56) References Cited

U.S. PATENT DOCUMENTS

| | | | | |
|---|---|---|---|---|
| 2007/0068927 | A1 | 3/2007 | Bohlender et al. | |
| 2008/0073336 | A1 | 3/2008 | Bohlender et al. | |
| 2009/0026191 | A1 * | 1/2009 | Bohlender et al. | 219/520 |

FOREIGN PATENT DOCUMENTS

| | | | | | |
|---|---|---|---|---|---|
| CN | 101179899 | A | | 5/2008 | |
| EP | 0 300 132 | A1 | | 1/1989 | |
| JP | 4-258982 | A | | 9/1992 | |
| JP | 5-1195 | U | | 1/1993 | |
| JP | 05-343168 | A | | 12/1993 | |
| JP | 6-73655 | U | | 10/1994 | |
| JP | 7-77882 | A | | 3/1995 | |
| JP | 8-138836 | A | | 5/1996 | |
| JP | 08-138836 | A | | 5/1996 | |
| JP | 9-204978 | A | | 8/1997 | |
| JP | 3091861 | U | | 11/2002 | |
| JP | 2007-103939 | A | | 4/2007 | |
| JP | 2007-147259 | A | | 6/2007 | |
| JP | 2008-71553 | A | | 3/2008 | |
| JP | 2008071553 | A | * | 3/2008 | H05B 3/06 |
| JP | 2008-84827 | A | | 4/2008 | |
| KR | 10-2005-0025368 | A | | 3/2005 | |
| KR | 10-2005-0097808 | | | 10/2005 | |
| KR | 10-0688542 | B1 | | 3/2007 | |
| KR | 10-2007-0035729 | A | | 4/2007 | |
| KR | 10-2007-0045541 | A | | 5/2007 | |
| KR | 10-0720131 | B1 | | 5/2007 | |
| KR | 10-2007-0060272 | A | | 6/2007 | |
| KR | 10-0759580 | B1 | | 9/2007 | |
| KR | 10-0791665 | B1 | | 1/2008 | |
| KR | 10-0831832 | B1 | | 5/2008 | |
| KR | 10-0836852 | B1 | | 6/2008 | |

* cited by examiner

POSITIVE TEMPERATURE COEFFICIENT (PTC) ROD ASSEMBLY AND PTC HEATER USING THE SAME

CROSS-REFERENCE TO RELATED APPLICATION

The present application claims priority of Korean Patent Application Number 10-2008-0123102 filed Dec. 5, 2008, the entire contents of which application is incorporated herein for all purposes by this reference.

BACKGROUND OF THE INVENTION

1. Field of the Invention

The present invention relates to a positive temperature coefficient (PTC) rod assembly and a PTC heater using the same, and more particularly, to a PTC rod assembly in which PTC elements and an electrode terminal to which an insulator is attached are retained in a channel-shaped rod cover having an open side so as to be exposed to the outside, and a heat-radiating fin is in direct contact with one surface of the rod cover so as to conduct heat, and another heat-radiating fin is in direct contact with one surface of the insulator attached to an outer surface of the electrode terminal so as to conduct heat, thereby minimizing an empty space in an inner space of the rod cover, increasing heat transfer efficiency, and being easily manufactured due to a simple structure and reduction in the number of parts, and a PTC heater in which a heat-radiating fin contacting a rod cover and another heat-radiating fin contacting an insulator of an electrode terminal are contacted and coupled with opposite surfaces of the PTC rod assembly, thereby increasing heat transfer efficiency with respect to the heat-radiating fins, and improving entire energy efficiency and performance.

2. Description of Related Art

A vehicle is equipped with an air conditioning system for selectively supplying cold and warm air to the inside thereof. In the summer season, an air conditioner is actuated to supply the cold air. In the winter season, a heater is actuated to supply the warm air.

In general, the heater is based on a heating system in which coolant heated by circulating through an engine exchanges heat with air introduced by a fan, so that warmed air is supplied to the inside of the vehicle. This heating system has high energy efficiency because it uses the heat generated from the engine.

However, in the winter season, it takes some time until the engine is heated after starting. Thus, after starting, heating is not immediately available. As such, for the heating, the engine often idles for a predetermined time prior to moving the vehicle until the engine is heated to raise the temperature of the coolant. This idling of the engine causes energy waste and environmental pollution.

In order to prevent this problem, a use has been made of a method of heating the interior of the vehicle using a separate pre-heater for a predetermined time while the engine is being warmed up. A conventional heater using a heating coil effectively performs the heating due to a high quantity of heat, but its parts are frequently repaired and exchanged due to a short lifetime of the heating coil.

Thus, a heater using a positive temperature coefficient (PTC) element has recently been developed. This PTC heater has low fire danger, and can guarantee semi-permanent use due to a long lifetime.

As illustrated in FIG. 1, a PTC pre-heater includes PTC rod assemblies 10, each of which has a PTC element, heat-radiating fin assemblies 20, which are disposed in parallel on opposite sides of the respective PTC rod assemblies 10 in pairs, and cathode terminals 30 disposed in parallel between the heat-radiating fin assemblies 20. The PTC pre-heater further includes frames 40 and 50 mounted on opposite outer sides of a coupling block in which the PTC rod assemblies 10, heat-radiating fin assemblies 20 and cathode terminals 30 are coupled to each other, and housings 60 and 70 coupled to opposite longitudinal ends of a coupling block in which the PTC rod assemblies 10, heat-radiating fin assemblies 20, cathode terminals 30 and the frames 40 and 50 are coupled to each other.

As illustrated in FIGS. 2 and 3, a lower rod cover 11 has a channel shape, and serves as a kind of a container. An insulator 12 is disposed in the bottom of the lower rod cover 11 so as to prevent a short circuit. The insulator 12 is made of a material having properties of a nonconductor such as nylon and good thermal conductivity.

An anode terminal 17 is fixedly coupled on the insulator 12 in a longitudinal direction, and is made of a metal such as carbon steel or aluminum. PTC elements 18 are placed on the anode terminal 17, are fixedly coupled to the insulator 12, and are powered to generate heat. Further, an upper rod cover 19 is placed on the PTC elements 18, and is coupled with the lower rod cover 11. Electric current flows to each cathode terminal 30 through the upper and lower rod covers 11 and 19.

However, a PTC rod assembly having this structure has problems in that many parts are assembled because the insulator 12 are separately required, in that a shape of each part is complicated, making an assembling process difficult, and in that the thickness thereof is increased. Thus, an insulating effect is increased to deteriorate heat transfer efficiency. Further, the lower rod cover 11 is not in direct contact with the PTC elements 18 from the structural point of view, and air exists between the parts, so that the heat transfer efficiency of the PTC elements is lowered. Due to expansion of internal air caused by heating, the parts are separated from each other, so that the air leaks out when the pre-heater is initially driven, thereby causing noise and lowering performance.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention provide for a positive temperature coefficient (PTC) rod assembly in which PTC elements and an electrode terminal to which an insulator is attached are retained in a channel-shaped rod cover having an open side so as to be exposed to the outside, and a heat-radiating fin may be in direct contact with one surface of the rod cover so as to conduct heat, and another heat-radiating fin may be in direct contact with one surface of the insulator attached to an outer surface of the electrode terminal so as to conduct heat, thereby minimizing an empty space in an inner space of the rod cover, increasing heat transfer efficiency, and being easily manufactured due to a simple structure and reduction in the number of parts.

Various embodiments of the present invention provide for a PTC heater in which a heat-radiating fin contacting a rod cover and another heat-radiating fin contacting an insulator of an electrode terminal are contacted and coupled with opposite surfaces of the PTC rod assembly, thereby increasing heat transfer efficiency with respect to the heat-radiating fins, and improving entire energy efficiency and performance.

In various embodiments of the present invention, the PTC rod assembly may include a rod cover having an open side in a channel shape and flanges protruding inwards from opposite edges thereof, a PTC element having a lower surface in contact with an inner bottom of the rod cover, and an electrode terminal caught by the flanges, being in contact with an upper surface of the PTC element, and retained in an inner space of the rod cover. Here, an insulator may be attached to an outer surface of the electrode terminal which is not in contact with the PTC element.

According to various embodiments of the present invention, the PTC elements and the electrode terminal to which the insulator is attached are retained in the channel-shaped rod cover having the open side so as to be exposed to the outside, and a heat-radiating fin may be in direct contact with one surface of the rod cover so as to be able to conduct heat, and another heat-radiating fin may be in direct contact with one surface of the insulator attached to the outer surface of the electrode terminal so as to be able to conduct heat, so that the PTC rod assembly minimizes an empty space in an inner space of the rod cover, increases heat transfer efficiency, and may be easily manufactured due to a simple structure and reduction in the number of parts.

Further, a heat-radiating fin contacting the rod cover and another heat-radiating fin contacting the insulator of the electrode terminal are contacted and coupled with opposite surfaces of the PTC rod assembly, so that the PTC heater increases heat transfer efficiency with respect to the heat-radiating fins, and improves entire energy efficiency and performance.

One aspect of the present invention is directed to a positive temperature coefficient rod assembly including a channel-shaped rod cover having an open side and flanges protruding inwards from opposite edges thereof, a positive temperature coefficient element having a lower surface in contact with an inner bottom of the rod cover, an electrode terminal caught by the flanges, being in contact with an upper surface of the positive temperature coefficient element, and retained in an inner space of the rod cover, and/or an insulator attached to an outer surface of the electrode terminal not in contact with the positive temperature coefficient element.

The rod cover may include fixing protrusions protruding downwards from opposite edges of a lower surface thereof so as to allow a heat-radiating fin to be fitted between the fixing protrusions. The insulator may include an anodized insulating coating layer. The insulator may include an insulating film attached to the outer surface of the electrode terminal. The rod cover may include fixing protrusions protruding downwards from opposite edges of a lower surface thereof so as to allow a heat-radiating fin to be fitted between the fixing protrusions. A vehicle heater may include any of the above-described positive temperature coefficient rod assemblies.

Another aspect of the present invention is directed to a positive temperature coefficient heater for a vehicle including a positive temperature coefficient rod assembly, which may include a channel-shaped rod cover having an open side and flanges protruding inwards from opposite edges thereof, a positive temperature coefficient element having a lower surface in contact with an inner bottom of the rod cover, an electrode terminal caught by the flanges, being in contact with an upper surface of the positive temperature coefficient element, and retained in an inner space of the rod cover, and/or an insulator attached to an outer surface of the electrode terminal which is not in contact with the positive temperature coefficient element. The heater may further include heat-radiating fins fitted between flanges of the rod cover so as to be in close contact with the insulator of the electrode terminal, and/or upper and lower housings coupled to upper and lower longitudinal ends of the positive temperature coefficient rod assembly and the heat-radiating fins.

The rod cover may include fixing protrusions protruding downwards from opposite edges of a lower surface thereof, and each of the heat-radiating fins is fitted between the fixing protrusions so as to be close contact with the lower surface of the rod cover.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Figure 1:
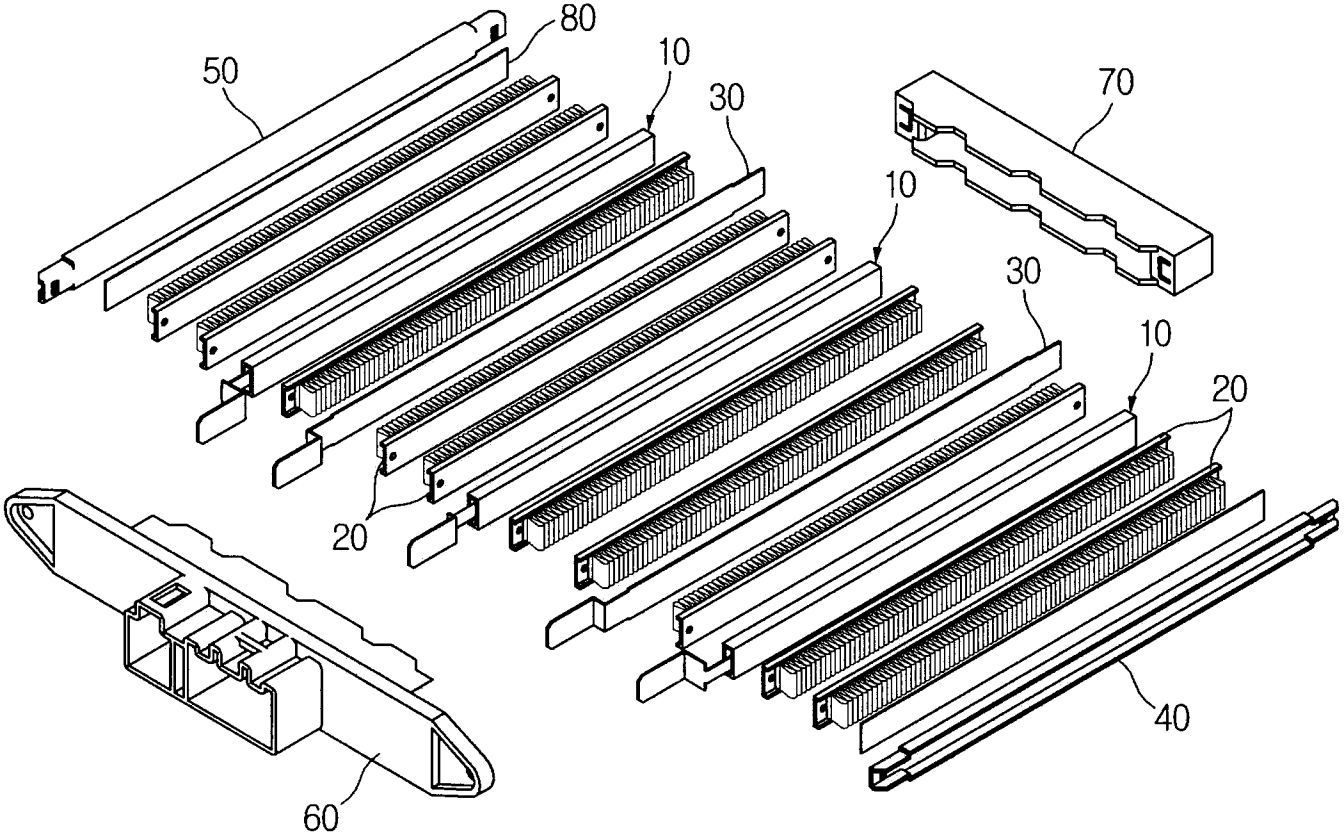
FIG. 1 is a schematic exploded perspective view illustrating an exemplary PTC pre-heater for a vehicle.
Figure 2:
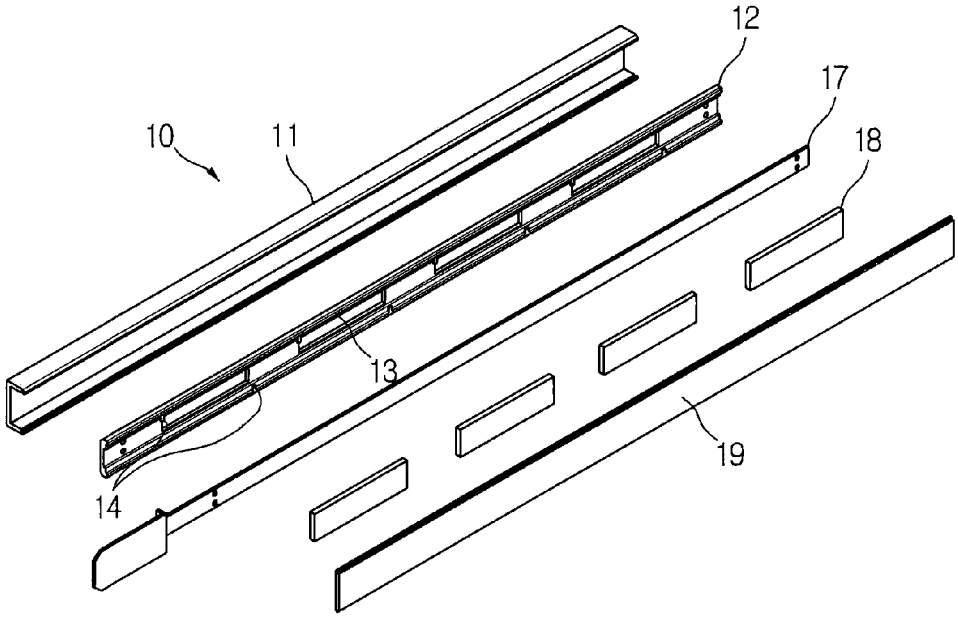
FIG. 2 is a schematic exploded perspective view illustrating the shape of an exemplary PTC rod assembly.
Figure 3:
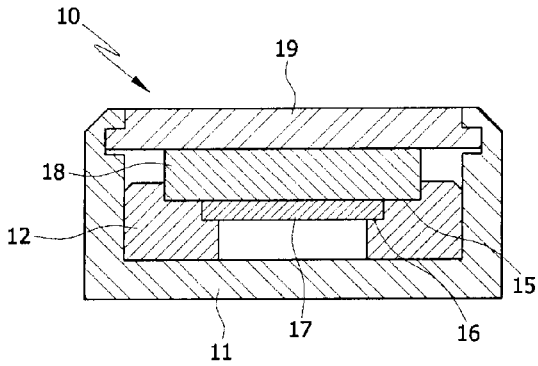
FIG. 3 is a cross-sectional view illustrating an exemplary PTC rod assembly.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In various embodiments, a positive temperature coefficient (PTC) rod assembly includes a channel-shaped rod cover 110 having an open side and flanges 111 protruding inwards from opposite edges thereof, PTC elements 180, lower surfaces of which are each in contact with an inner bottom of the rod cover 110, and an electrode terminal 170 caught by the flanges 111, being in contact with upper surfaces of the PTC elements 180, and retained in an inner space of the rod cover 110. An insulator 120 is attached to an outer surface of the electrode terminal 170 which is not in contact with the PTC elements 180.

Figure 4:
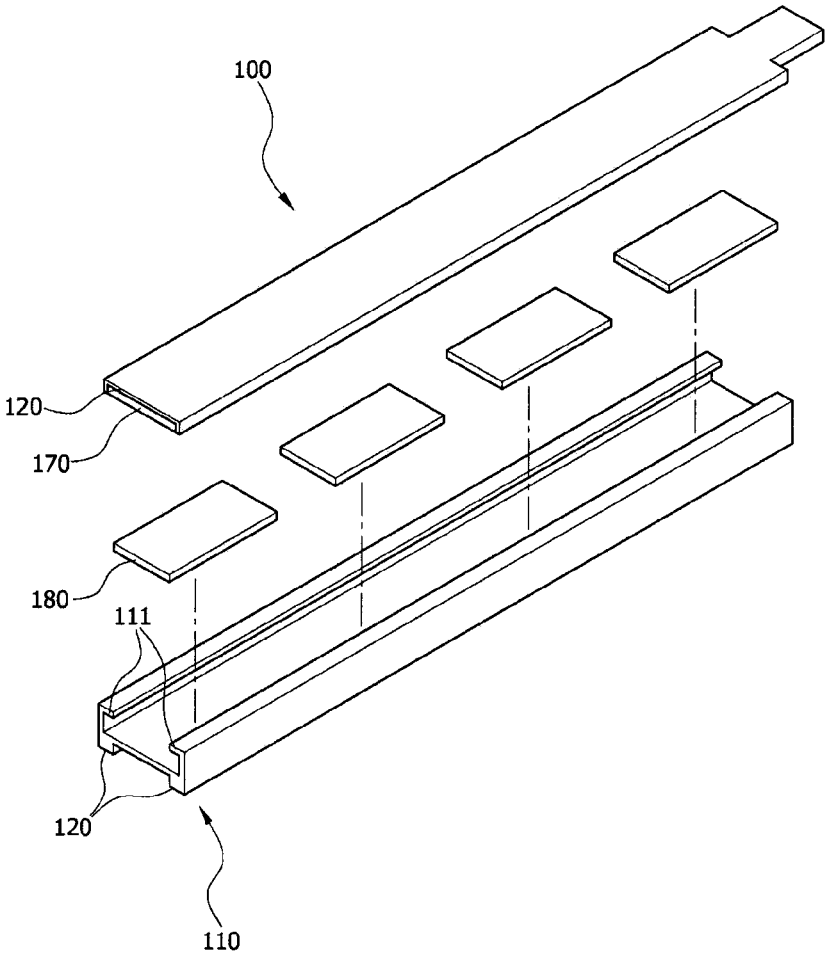
FIG. 4 is a schematic exploded perspective view illustrating the structure of an exemplary PTC rod assembly according to the present invention.
Figure 5:
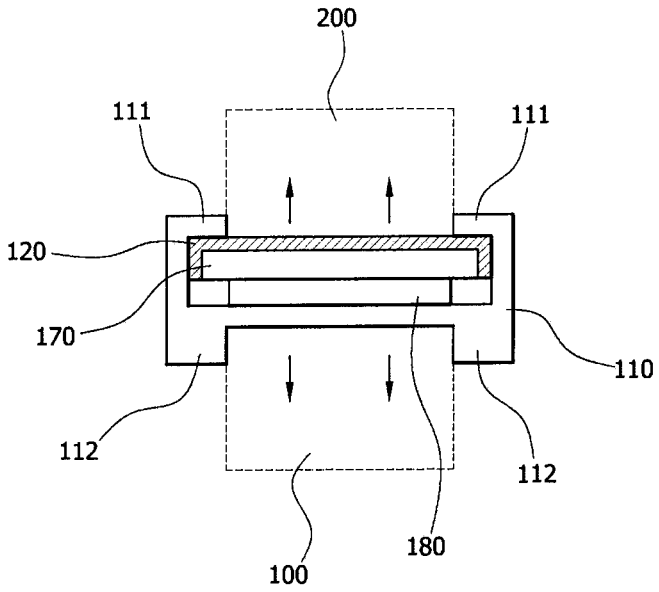
FIG. 5 is a schematic exploded perspective view illustrating the internal structure of an exemplary PTC rod assembly according to the present invention.

FIG. 4 is a schematic exploded perspective view illustrating the structure of a PTC rod assembly according to various embodiments of the present invention. FIG. 5 is a schematic exploded perspective view illustrating the internal structure of a PTC rod assembly according to various embodiments of the present invention.

As illustrated in FIG. 4, according to various embodiments of the present invention, the PTC rod assembly includes a rod cover 110 having an open side in a channel shape, PTC elements 180, lower surfaces of which are each in contact with an inner bottom of the rod cover 110, and an electrode terminal 170 being in contact with upper surfaces of the PTC elements 180 and having an insulator 120 attached to an outer surface thereof.

As illustrated in FIG. 4, the rod cover 110 is open to an upper surface thereof in a channel shape, and includes flanges 111 protruding inwards from opposite edges thereof. The PTC elements 180 are placed on and contacted with the inner bottom of the rod cover 110. The electrode terminal 170 is mounted in the inner space of the rod cover 110 in contact with the upper surface of each PTC element 180. At this time, the electrode terminal 170 is caught by the flanges protruding inwards from the opposite edges of the rod cover 110, and thus is retained in and fixed to the inner space of the rod cover 110. Further, the insulator 120 is attached to the outer surface of the electrode terminal 170 which is not in contact with the PTC elements 180, so that the electrode terminal 170 is electrically insulated from the rod cover 110.

Thus, according to various embodiments of the present invention, the PTC rod assembly is configured so that the PTC elements 180 and the electrode terminal 170 are retained in and fixedly coupled to the inner space of the rod cover 110 by the flanges 111 of the opposite edges of the rod cover 110, wherein the rod cover 110 has the channel shape in which one side thereof is open, rather than an integral tube shape or a closed shape in which it is divided into upper and lower parts.

As illustrated in FIG. 5, owing to this structure, the electrode terminal 170 is electrically insulated from the rod cover 110 by the insulator 120 without direct contact with the rod cover 110, and the PTC elements 180 are in contact with the inner surface of the rod cover 110, so that electric current flows from the electrode terminal 170 to the PTC elements 180. In detail, the electric current supplied from an external power supply to the electrode terminal 170 flows to the rod cover 110 through the PTC elements 180 contacting the electrode terminal 170. In this process, the PTC elements 180 electrically generate heat.

Thus, according to various embodiments of the present invention, the PTC rod assembly is different from existing assemblies in that the electrode terminal 170 is insulated from the rod cover 110, and in that a separate insulator on which the PTC elements 180 are placed is not required. Thus, the electrode terminal 170 and the PTC elements 180 contacting the electrode terminal 170 are pressed in and coupled to the inner space of the rod cover 110 by the flanges 111 of the rod cover 110, and the electrode terminal 170 is insulated by the insulator 120 attached to the outer surface thereof in a simple structure.

In this manner, according to various embodiments of the present invention, the PTC rod assembly is easily manufactured due to a simplified structure, is reduced in the number of parts and the resulting manufacturing cost, and increases heat transfer efficiency because the parts are coupled in such a manner that an empty space is minimized in the inner space of the rod cover 110.

More specifically, as illustrated in FIG. 5, since the PTC elements 180 and the electrode terminal 170 are retained in the inner space of the rod cover 110, one side of which is open, the outer surface of the electrode terminal 170 is open to the outside via the insulator 120 so as to be in direct contact with the outside. Thus, a PTC heater is configured in such a manner that a heat-radiating fin 200 is directly contacted with and coupled to the upper surface of the insulator 120 attached to the outer surface of the electrode terminal 170. This PTC heater transfers heat from the PTC elements 180 to the heat-radiating fin 200 on the basis of conduction, so that the heat transfer efficiency is greatly improved.

In detail, as illustrated in FIG. 5, the heat generated from the PTC elements 180 is transferred to the rod cover 110 through the lower surface of each PTC element 180, and is transferred to the electrode terminal 170 and the insulator 120 through the upper surface of each PTC element 180. Then, the heat is conducted to the heat-radiating fin 200 contacting the insulator 120. In this manner, the heat generated from the PTC elements 180 is conducted to the heat-radiating fins 200, which are contacted and coupled with opposite sides of the PTC rod assembly, through both of the lower and upper surfaces of each PTC element 180. Thus, the heat transfer efficiency of the PTC heater having this structure is further improved.

Meanwhile, as illustrated in FIG. 5, the rod cover 110 is preferably provided with fixing protrusions 112 protruding downwards from opposite edges of the lower surface thereof. Thus, the heat-radiating fin 200 can be easily fitted between the fixing protrusions 112, as illustrated in FIG. 5. Further, the flanges 111 of the rod cover 110 are preferably configured so that the heat-radiating fin 200 can be easily fitted between the flanges 111. In other words, the flanges 111 of the rod cover 110 serve as means for retaining the electrode terminal 170 in the inner space of the rod cover as well as means for fitting the heat-radiating fin 200.

Meanwhile, according to various embodiments of the present invention, the insulator 120 is preferably made of a material having good thermal conductivity, and the electrode terminal 70 can be configured in such a manner that an insulating surface thereof is anodized to form an insulating coating layer. Alternatively, a separate adhesive insulating film may be attached to the insulating surface of the electrode terminal 170.

Next, according to various embodiments of the present invention, in the PTC heater as described above, the PTC rod assembly 100 includes the PTC elements 180 and the electrode terminal 170 mounted on the rode cover 110 having the open side so as to be exposed to the outside. The heat-radiating fin 200 is fitted between the flanges 111 of the rod cover 110 so as to be in close contact with the insulator 120 attached to the outer surface of the electrode terminal 170. Upper and lower housings 60 and 70 are coupled to upper and lower longitudinal ends of the PTC rod assembly 100 and the heat-radiating fin 200 (see FIG. 1).

Here, as described above, more preferably, the rod cover 110 includes the fixing protrusions 112 protruding downwards from the opposite edges of the lower surface thereof, and the heat-radiating fin 200 is fitted between the fixing protrusions 112 so as to be in close contact with the lower surface of the rod cover 110.

As described above, this PTC heater conducts the heat generated from the PTC elements 180 to the heat-radiating fins 200 through both of the lower and upper surfaces of each PTC element 180, so that the heat transfer efficiency thereof is increased, and thus entire energy efficiency is improved.

For convenience in explanation and accurate definition in the appended claims, the terms "upper" or "lower", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A positive temperature coefficient rod assembly comprising:

first heat-radiating fins and second heat-radiating fins;

a channel-shaped rod cover having an open side and flanges protruding inwards from opposite edges thereof;

a plurality of positive temperature coefficient elements, each having a lower surface that is substantially entirely in contact with an inner bottom of the rod cover, wherein the positive temperature coefficient(PTC) elements are spaced apart from each other;

an electrode terminal caught by the flanges, being in contact with an upper surface of the plurality of the positive temperature coefficient elements, and retained in an inner space of the rod cover;

an insulator attached to an outer surface of the electrode terminal and not being in contact with the plurality of the positive temperature coefficient elements and preventing a direct contact between the plurality of the positive temperature coefficient elements and the first heat-radiating fins;

wherein a width of the plurality of positive temperature coefficient elements is smaller than a width of the rod cover;

wherein the electrode terminal and the PTC elements contacting the electrode terminal are pressed in and coupled to the inner space of the rod cover;

wherein the first heat-radiating fins are fitted between the flanges of the rod cover so as to be in close contact with the insulator of the electrode terminal; and wherein the rod cover includes fixing protrusions protruding downwards from opposite edges of a lower surface thereof for retaining the second heat-radiating fins that are fitted between the fixing protrusions so that the second heat-radiating fins are in direct contact with the lower surface of the rod cover.

2. The positive temperature coefficient rod assembly according to claim 1, wherein the insulator includes an anodized insulating coating layer.

3. The positive temperature coefficient rod assembly according to claim 1, wherein the insulator comprises an insulating film attached to the outer surface of the electrode terminal.

4. A vehicle heater comprising the positive temperature coefficient rod assembly according to claim 1.

5. A positive temperature coefficient heater for a vehicle comprising:

first heat-radiating fins;

second heat-radiating fins; and a positive temperature coefficient rod assembly including:

a channel-shaped rod cover having an open side and flanges protruding inwards from opposite edges thereof;

a plurality of positive temperature coefficient elements, each having a lower surface that is substantially entirely in contact with an inner bottom of the rod cover, wherein the positive temperature coefficient elements are spaced apart from each other;

an electrode terminal caught by the flanges, being in contact with an upper surface of the plurality of the positive temperature coefficient elements, and retained in an inner space of the rod cover; and an insulator attached to an outer surface of the electrode terminal wherein the insulator is not in contact with the positive temperature coefficient element;

wherein the electrode terminal and the PTC elements contacting the electrode terminal are pressed in and coupled to the inner space of the rod cover;

wherein a width of the plurality of positive temperature coefficient elements is smaller than a width of the rod cover;

wherein the first heat-radiating fins are fitted between the flanges of the rod cover so as to be in close contact with the insulator of the electrode terminal;

wherein the rod cover includes fixing protrusions protruding downwards from opposite edges of a lower surface thereof for retaining the second heat-radiating fins that are fitted between the fixing protrusions so that the second heat-radiating fins are in direct contact with the lower surface of the rod cover; and wherein upper and lower housings are coupled to upper and lower longitudinal ends of the positive temperature coefficient rod assembly and the first and second heat-radiating fins.

* * * * *